United States Patent [19]

Owen et al.

[11] Patent Number: 5,043,055

[45] Date of Patent: Aug. 27, 1991

[54] PROCESS AND APPARATUS FOR HOT CATALYST STRIPPING ABOVE A BUBBLING BED CATALYST REGENERATOR

[75] Inventors: Hartley Owen, Belle Mead, N.J.; Paul H. Schipper, Wilmington, Del.

[73] Assignee: Mobil Oil Corporation, Fairfax, Va.

[21] Appl. No.: 515,923

[22] Filed: Apr. 27, 1990

[51] Int. Cl.[5] ..... C10G 11/00; C10G 35/10; B01J 20/34

[52] U.S. Cl. ..... 208/113; 208/158; 208/159; 208/160; 208/164; 502/40; 502/43; 502/44

[58] Field of Search ..... 208/113, 158, 159, 160, 208/164; 502/40, 43, 44

[56] References Cited

U.S. PATENT DOCUMENTS 4,789,458 12/1988 Haddad et al. ..... 208/151
4,820,404 4/1989 Owen ..... 208/159

OTHER PUBLICATIONS

*Oil and Gas Journal*, "Fluid Catalytic Cracking Report", by Amos A. Avidan, Michael Edwards, and Hartley Owen.

*Primary Examiner*—Anthony McFarlane
*Assistant Examiner*—Hnat Phan
*Attorney, Agent, or Firm*—Alexander J. McKillop; Charles J. Speciale; Richard D. Stone

[57] ABSTRACT

A process and apparatus for achieving multistage, hot catalyst stripping of spent FCC catalyst in a bubbling bed regenerator having a stripper mounted over the regenerator and a stripped catalyst standpipe within the regenerator. Hot catalyst stripping is achieved by lifting regenerated catalyst into the conventional stripper or to a secondary catalyst stripper under the primary stripper. Spent catalyst is heated by direct contact heat exchange with hot regenerated catalyst. Three different types of lift gas may be used to transport catalyst from the regenerator to the hot stripper, a light reactive hydrocarbon, an inert, or steam.

11 Claims, 4 Drawing Sheets

PROCESS AND APPARATUS FOR HOT CATALYST STRIPPING ABOVE A BUBBLING BED CATALYST REGENERATOR

BACKGROUND OF THE INVENTION

1. Field of the Invention

The invention relates to a process and apparatus for stripping and regenerating fluidized catalytic cracking catalyst.

2. Description of Related Art

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425° C.-600° C., usually 460° C.-560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.-900° C., usually 600° C.-750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking has undergone progressive development since the 40s. The trend of development of the fluid catalytic cracking (FCC) process has been to all riser cracking and use of zeolite catalysts. A good overview of the importance of the FCC process, and its continuous advancement, is reported in Fluid Catalytic Cracking Report, Amos A. Avidan, Michael Edwards and Hartley Owen, as reported in the Jan. 8, 1990 edition of the Oil & Gas Journal.

Modern catalytic cracking units us active zeolite catalyst to crack the heavy hydrocarbon feed to lighter, more valuable products. Instead of dense bed cracking, with a hydrocarbon residence time of 20-60 seconds, much less contact time is needed. The desired conversion of feed can now be achieved in much less time, and more selectively, in a dilute phase, riser reactor.

Although reactor residence time has continued to decrease, the height of the reactors has not. Although the overall size and height of much of the hardware associated with the FCC unit has decreased, the use of all riser reactors has resulted in catalyst and cracked product being discharged from the riser reactor at a fairly high elevation. This elevation makes it easy for a designer to transport spent catalyst from the riser outlet, to a catalyst stripper at a lower elevation, to a regenerator at a still lower elevation.

The need for a somewhat vertical design, to accommodate the great height of the riser reactor, and the need to have a unit which is compact, efficient, and has a small "footprint", has caused considerable evolution in the design of FCC units, which evolution is reported to a limited extent in the Jan. 8, 1990 Oil & Gas Journal article. One modern, compact FCC design is the Kellogg Ultra Orthoflow converter, Model F, which is shown in FIG. 1 of this patent application, and also shown as FIG. 17 of the Jan. 8, 1990 Oil & Gas Journal article discussed above. The compact nature of the design, and the use of a catalyst stripper which is contiguous with and supported by the catalyst regenerator, makes it difficult to expand or modify such units. The catalyst stripper design is basically a good one, which achieves some efficiencies because of its location directly over the bubbling bed regenerator. The stripper can be generously sized, does not have to fit around the riser reactor as in many other units, and the stripper is warmed slightly by its close proximity to the regenerator, which will improve its efficiency slightly.

Although such a unit works well in practice, the stripping of spent catalyst is never as complete as desired by the refiner. In addition, FCC units are being pushed to accept poorer feeds, particularly feeds containing large amounts of resid. These growing demands placed on FCC units exacerbated four existing problem areas in the regenerator, namely problems with sulfur, steam, temperature and NOx. These problems will each be reviewed in more detail below.

SULFUR

Much of the sulfur in the feed ends up as SOx in the regenerator flue gas. Higher sulfur levels in the feed, combined with a more complete regeneration of the catalyst in the regenerator increases the amount of SOx in the regenerator flue gas. Some attempts have been made to minimize the amount of SOx discharged to the atmosphere through the flue gas by including catalyst additives or agents to react with the SOx in the flue gas. These agents pass with the regenerated catalyst back to the FCC reactor where the reducing atmosphere releases the sulfur compounds as H2S. Suitable agents are described in U.S. Pat. Nos. 4,071,436 and 3,834,031. Use of cerium oxide agent for this purpose is shown in U.S. Pat. No. 4,001,375.

Unfortunately, the conditions in most FCC regenerators are not the best for SOx adsorption. The high temperatures in modern FCC regenerators (up to 870° C. (1600° F.)) impair SOx adsorption. One way to minimize SOx in flue gas is to pass catalyst from the FCC reactor to a long residence time steam stripper, as disclosed in U.S. Pat. No. 4,481,103 to Krambeck et al which is incorporated by reference. This process preferably steam strips spent catalyst at 500°-550° C. (932° to 1022° F.), which is beneficial but not sufficient to remove some undesirable sulfur- or hydrogen-containing components.

STEAM

Steam is always present in FCC regenerators although it is known to cause catalyst deactivation. Steam is not intentionally added, but is invariably present, usually as adsorbed or entrained steam from steam stripping or catalyst or as water of combustion formed in the regenerator.

Poor stripping leads to a double dose of steam in the regenerator, first from the adsorbed or entrained steam and second from hydrocarbons left on the catalyst due to poor catalyst stripping. Catalyst passing from an FCC stripper to an FCC regenerator contains hydrogen-containing components, such as coke or unstripped hydrocarbons adhering thereto. This hydrogen burns in the regenerator to form water and cause hydrothermal degradation.

Steaming of catalyst becomes more of a problem as regenerators get hotter. Higher temperatures greatly accelerate the deactivating effects of steam.

TEMPERATURE

Regenerators are operating at higher and higher temperatures. This is because most FCC units are heat balanced, that is, the endothermic heat of the cracking reaction is supplied by burning the coke deposited on the catalyst. With heavier feeds, more coke is deposited on the catalyst than is needed for the cracking reaction. The regenerator gets hotter, and the extra heat is rejected as high temperature flue gas. Many refiners severely limit the amount of resid or similar high CCR feeds to that amount which can be tolerated by the unit. High temperatures are a problem for the metallurgy of many units, but more importantly, are a problem for the catalyst. In the regenerator, the burning of coke and unstripped hydrocarbons leads to much higher surface temperatures on the catalyst than the measured dense bed or dilute phase temperature. This is discussed by Occelli et al in Dual-Function Cracking Catalyst Mixtures, Ch. 12, Fluid Catalytic Cracking, ACS Symposium Series 375, American Chemical Society, Washington, D.C., 1988.

Some regenerator temperature control is possible by adjusting the CO/CO2 ratio produced in the regenerator. Burning coke partially to CO produces less heat than complete combustion to CO2. However, in some cases, this control is insufficient, and also leads to increased CO emissions, which can be a problem unless a CO boiler is present.

U.S. Pat. No. 4,353,812 to Lomas et al, which is incorporated by reference, discloses cooling catalyst from a regenerator by passing it through the shell side of a heat-exchanger with a cooling medium through the tube side. The cooled catalyst is recycled to the regeneration zone. The Kellogg H.O.C. regenerator has a catalyst cooler connected to the dense bed of the regenerator. These approaches remove heat from the regenerator, but will not prevent poorly, or even well, stripped catalyst from experiencing very high surface or localized temperatures in the regenerator.

The prior art also used dense or dilute phase regenerated fluid catalyst heat removal zones or heat-exchangers that are remote from, and external to, the regenerator vessel to cool hot regenerated catalyst for return to the regenerator. Examples of such processes are found in U.S. Pat. Nos. 2,970,117 to Harper; 2,873,175 to Owens; 2,862,798 to McKinney; 2,596,748 to Watson et al; 2,515,1.6 to Jahnig et al; 2,492,948 to Berger; and 2,506,123 to Watson.

NOX

Burning of nitrogenous compounds in FCC regenerators has long led to creation of minor amounts of NOx, some of which were emitted with the regenerator flue gas. Usually these emissions were not much of a problem because of relatively low temperature, a relatively reducing atmosphere from partial combustion of CO and the absence of catalytic metals like Pt in the regenerator which increase NOx production.

Many FCC units now operate at higher temperatures, with a more oxidizing atmosphere, and use CO combustion promoters such as Pt. These changes in regenerator operation reduce CO emissions, but usually increase nitrogen oxides (NOx) in the regenerator flue gas. It is difficult in a catalyst regenerator to completely burn coke and CO in the regenerator without increasing the NOx content of the regenerator flue gas, so NOx emissions are now frequently a problem. These problems are more severe in bubbling bed regenerators, because of relatively poor catalyst circulation (large stagnant regions in the dense bed) and the presence of large bubbles of regeneration gas which leads to localized high concentrations of oxygen, which increases NOx emissions.

Recent catalyst patents include U.S. Pat. No. 4,300,997 and its division U.S. Pat. No. 4,350,615, both directed to the use of Pd-Ru CO-combustion promoter. The bi-metallic CO combustion promoter is reported to do an adequate job of converting CO to CO2, while minimizing the formation of NOx.

U.S. Pat. No. 4,199,435 suggests steam treating conventional metallic CO combustion promoter to decrease NOx formation without impairing too much the CO combustion activity of the promoter.

Process modifications are suggested in U.S. Pat. Nos. 4,413,573 and 4,325,833 directed to two-and three-stage FCC regenerators, which reduce NOx emissions.

U.S. Pat. No. 4,313,848 teaches countercurrent regeneration of spent FCC catalyst, without backmixing, to minimize NOx emissions.

While such process modifications may be useful for new construction they can not be easily added to existing units, especially not to compact regenerator/stripper designs such as the Kellogg H.O.C. regenerator.

U.S. Pat. No. 4,309,309 teaches the addition of a vaporizable fuel to the upper portion of a FCC regenerator to minimize NOx emissions. Oxides of nitrogen formed in the lower portion of the regenerator are reduced in the reducing atmosphere generated by burning fuel in the upper portion of the regenerator.

U.S. Pat. No. 4,235,704 suggests that too much CO combustion promoter causes NOx formation, and calls for monitoring the NOx content of the flue gases, and adjusting the concentration of CO combustion promoter in the regenerator based on the amount of NOx in the flue gas.

The approach taken in U.S. Pat. No. 4,542,114 is to minimize the volume of flue gas by using oxygen rather than air in the FCC regenerator, with consequent reduction in the amount of flue gas produced.

All the catalyst and process patents discussed above, directed to reducing NOx emissions, from U.S. Pat. Nos. 4,300,997 to 4,542,114, are incorporated herein by reference.

The reduction in NOx emissions achieved by the above approaches helps some but still may fail to meet the ever more stringent NOx emissions limits set by local governing bodies. Much of the NOx formed is not the result of combustion of N2 within the FCC regenerator, but rather combustion of nitrogen-containing compounds in the coke entering the FCC regenerator.

Unfortunately, the trend to heavier feeds usually means that the amount of nitrogen compounds on the coke will increase so NOx emissions will increase. Higher regenerator temperatures also tend to increase NOx emissions. It would be beneficial, in existing refineries, to have a way to reduce NOx emissions so that heavier feeds, and environmental concerns, can be accommodated.

We realized that a better catalyst stripper design is needed. A better stripper would attack most of the problems in the regenerator at their source, namely poor stripping. Better stripping would permit increased recovery of valuable, strippable hydrocarbons and remove more hydrogen from spent catalyst to minimize hydrothermal degradation in the regenerator. It would also remove more sulfur-containing compounds from spent catalyst prior to regeneration to minimize SOx in the regenerator flue gas and would help reduce regenerator temperature by reducing the amount of material burned in it. The problems were obvious, but a solution to these problems, which could be incorporated into existing FCC regenerators, especially compact designs, was not.

We reviewed the work that others had done on improving stripping, and found nothing directly applicable to the special problems of better stripping in FCC units where the stripper was so closely associated with, and supported by, a bubbling dense bed regenerator. The improvements in stripping in FCC units where the stripper was remote from the regenerator were not directly applicable. Thus we could not readily use the hot stripper design of U.S. Pat. No. 4,820,404 (Owen), which is easiest to implement in units where the regenerator is at a higher elevation that the catalyst stripper. For similar reasons we could not use the multi-stage hot strippers of U.S. Pat. No. 4,789,458 (Haddad, Owen, Schatz).

We discovered a way to achieve high temperature stripping of coked FCC catalyst which could be readily retrofitted into strippers operating above and supported by bubbling dense bed regenerators. We discovered a way to make the vices of the existing design, its compactness and proximity to the bubbling bed regenerator, virtues which allowed us to achieve an unexpectedly effective hot stripping design. We found a way to improve stripping, increase the yield of valuable liquid product, reduce the load placed on the catalyst regenerator, minimize SOx and NOx emissions and permit the unit to process more difficult feeds. Regenerator temperatures can be reduced somewhat, and the hydrothermal deactivation of catalyst in the regenerator reduced.

We also devised a way to recycle hot regenerated catalyst, for use in direct contact heat exchange in the hot stripper, without steaming the regenerated catalyst, and without adding oxygen or inerts to the cracked products. We could also upgrade a light hydrocarbon stream by contact with cracking catalyst, without loading up the conventional riser reactor with this light stream. We were able to accomplish this generally within the confines of existing equipment.

BRIEF SUMMARY OF THE INVENTION

Accordingly, the present invention provides a fluidized catalytic cracking process wherein a heavy hydrocarbon feed comprising hydrocarbons having a boiling point above about 650° F. is catalytically cracked to lighter products comprising the steps of catalytically cracking said feed in a catalytic cracking zone operating at catalytic cracking conditions by mixing, in the base of a riser reactor, a heavy crackable feed with a source of hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst separating cracked products from spent catalyst in said catalyst disengaging zone to produce a cracked product vapor phase which is recovered as a product and a spent catalyst phase which is discharged from said disengaging zone into a catalyst stripper contiguous with and beneath said disengaging zone; steam stripping said spent catalyst with stripping steam in said stripping zone to produce a stripper vapor comprising cracked products and stripping steam which is removed from said stripping zone as a product and a stripped catalyst phase comprising stripped catalyst having a temperature is discharged into a vertical standpipe beneath said stripping zone; discharging stripped catalyst from said standpipe into a catalyst regeneration zone contiguous with and beneath said stripping zone regenerating said stripped catalyst in a regeneration zone comprises a single dense phase bubbling fluidized bed of catalyst to which an oxygen containing regeneration gas is added and from which hot regenerated catalyst, having a regenerated catalyst temperature above said stripped catalyst temperature, is withdrawn and recycled to said riser reactor, characterized by: heating said stripped catalyst from said steam catalyst stripper by direct contact heat exchange with hot regenerated catalyst from said bubbling dense bed, discharging the resulting heated catalyst into a hot stripping zone and stripping said heated catalyst therein by adding a stripping gas to said hot stripper, and stripping additional cracked products from said stripped catalyst to produce hot stripped catalyst which is charged to said catalyst regeneration zone and hot stripper vapor which is removed as a product.

In an apparatus embodiment, the present invention provides an apparatus for the fluidized catalytic cracking of a heavy feed to lighter more valuable products comprising: a riser reactor cracking means having a base portion connective with a source of heavy feed and connective with a bubbling dense phase fluidized bed of regenerated catalyst within a catalyst regeneration means; a riser outlet at the top of the riser reactor connective with a catalyst disengaging means adapted to separate a cracked product vapor stream from a spent catalyst stream, and discharge said spent catalyst into a catalyst stripper means; a primary catalyst stripping means, located above and supported by said catalyst regeneration means, said stripping means adapted to receive spent catalyst from said disengaging means and contact said spent catalyst with a stripping gas to produce a stripper effluent vapor stream and a stripped catalyst stream which is discharged down into a primary stripper catalyst standpipe; and a secondary catalyst stripping means, located beneath said primary catalyst stripping means; and a catalyst regeneration means adaptive to receive catalyst discharged from said secondary stripping means and maintain said stripped catalyst as a bubbling dense phase fluidized bed of catalyst and regenerate spent catalyst by contact with a source of regeneration gas and produce a regenerated catalyst stream and a dilute phase flue gas stream comprising entrained catalyst; a catalyst recycle means adapted to transport hot regenerated catalyst from said bubbling dense bed regenerator to said secondary catalyst stripping means.

DESCRIPTION OF PREFERRED EMBODIMENTS

Figure 1:
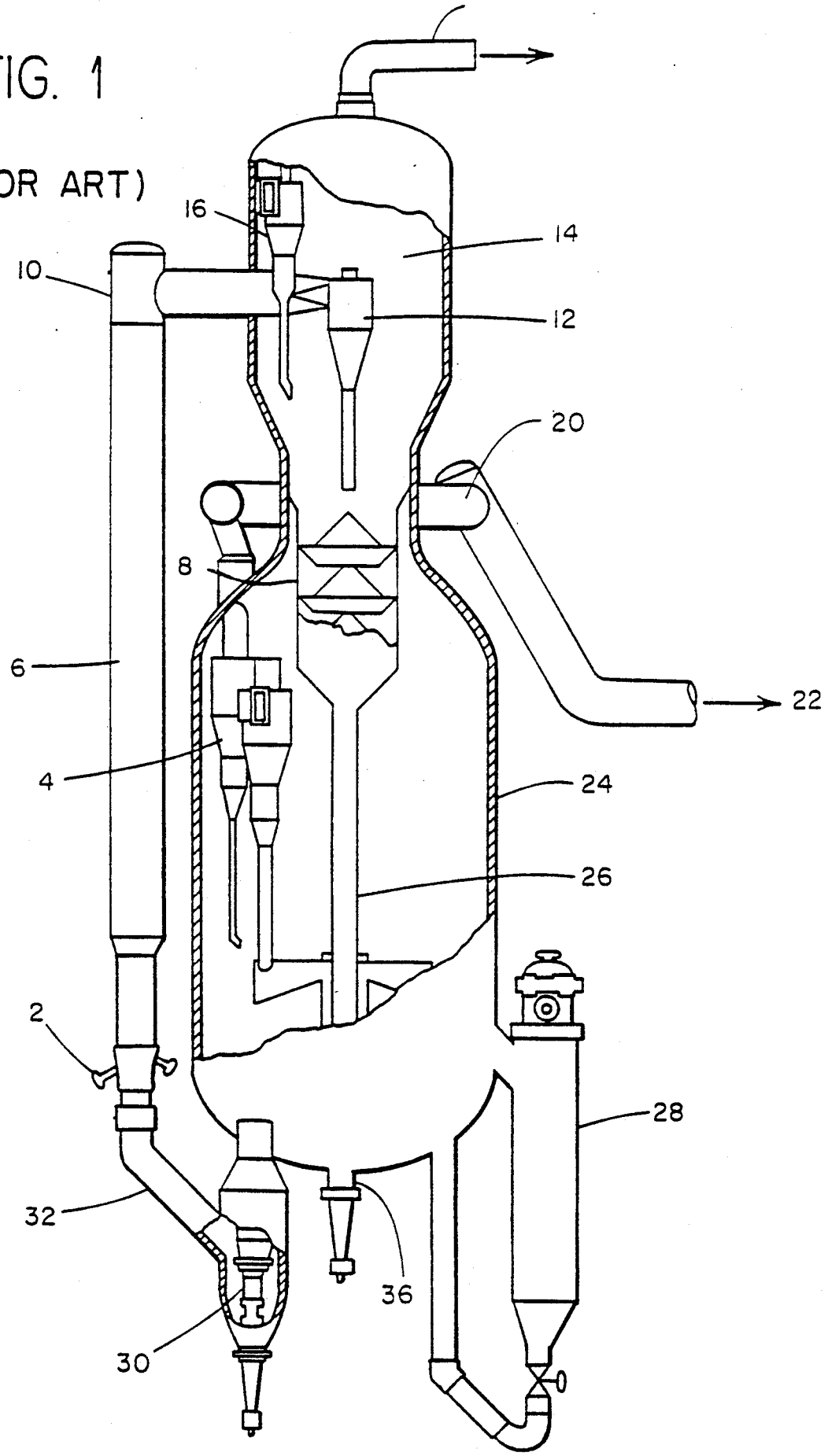
FIG. 1 (PRIOR ART)
FIG. 1 (prior art) is a schematic view of a conventional fluidized catalytic cracking unit.

FIG. 1 is a simplified schematic view of an FCC unit of the prior art, similar to the Kellogg Ultra Orthoflow converter Model F shown as FIG. 17 of Fluid Catalytic Cracking Report, in the Jan. 8, 1990 edition of Oil & Gas Journal.

A heavy feed such as a gas oil, vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually is removed via upper cyclones 16 and conduit 1 to the fractionator.

Spent catalyst is discharged down from a dipleg of riser cyclones 12 into catalyst stripper 8, where one, or preferably 2 or more, stages of steam stripping occur, with stripping steam admitted by means not shown in the figure. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28 is provided so that heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed. Flue gas, and some entrained catalyst, are discharged into a dilute phase region in the upper portion of regenerator 24. Entrained catalyst is separated from flue gas in multiple stages of cyclones 4, and discharged via outlets 8 into plenum 20 for discharge to the flare via line 22.

Figure 2:
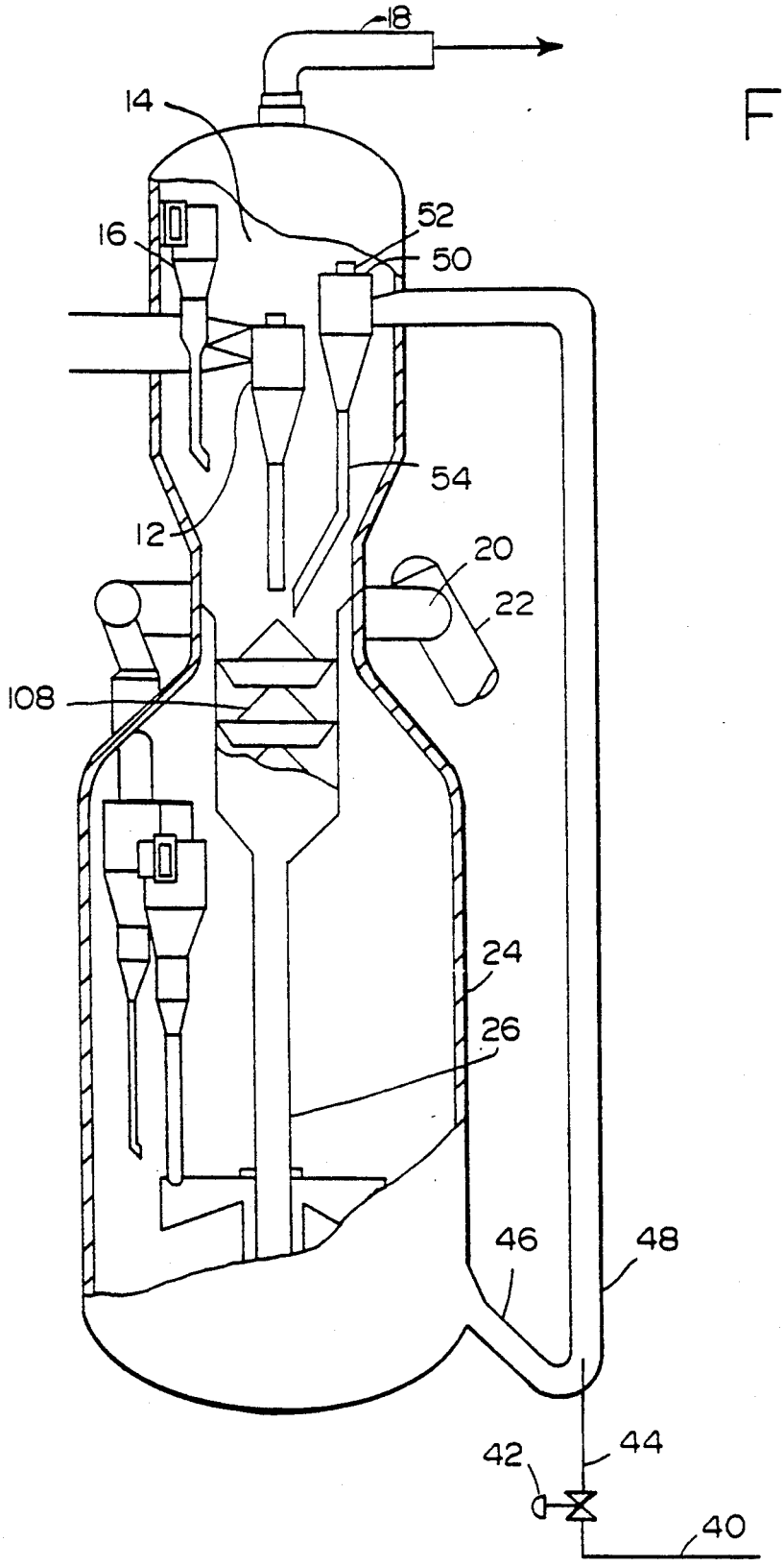
FIG. 2 (invention) is a schematic view of a preferred embodiment of the invention, showing hot catalyst recycle to a hot stripper, with naphtha cracking/transport of catalyst to the hot stripper.

In FIG. 2 (invention) only the changes made to the old unit are shown, and many essential and/or conventional details, such as the riser reactor and catalyst cooler have been omitted. Like elements in FIG. 1 and 2 have like numerals.

This embodiment is especially preferred when it is desired to have both hot stripping of catalyst, and to achieve some additional conversion of light hydrocarbon streams, with minimum capital investment or modification to the existing disengaging section associated with the riser reactor.

A hot stripper 108 is created by merely recycling some hot, regenerated catalyst into the existing catalyst stripper (labelled stripper 8 in FIG. 1). Stripping steam, or other stripping medium, is added by conventional means not shown, and the stripped hydrocarbons, and stripping gas, are removed in the same way as in the conventional stripping operation used in the FIG. 1 embodiment.

Hot catalyst is withdrawn from the bubbling dense bed regenerator 24 via catalyst outlet 46, and contacts a light hydrocarbon stream added via line 40, flow control valve 42 and light hydrocarbon injection nozzle 44 in the base of hot catalyst recycle riser 48. The light hydrocarbons contemplated for use as a lift gas in this embodiment are relatively low coking stocks, and although a measure of conversion is achieved, and is beneficial, there is little coke formation and little cooling of catalyst in riser 48. The hot catalyst, cracked products, and uncracked lift gas are preferably discharged into a catalyst/gas separation means such as cyclone separator 50. Cracked products and lift gas are discharged via cyclone outlet 52 into the dilute phase region 14 of the disengager, to mix with cracked products, stripping steam, etc., and be recovered via line 18. Hot recycled catalyst is discharged via cyclone dipleg 54 to mix with spent cracking catalyst added to the hot stripper 108.

Various catalyst flow splitters, mixing vanes, multiple radially distributed diplegs 54 and similar means may be used to improve contact of hot recycled catalyst (from riser 48) with spent cracking catalyst. A significant amount of direct contact heat exchange, and mixing, will occur automatically during stripping, so the cost and reliability of mixing devices must be weighed against the benefits of improved heating.

The embodiment shown in FIG. 3 requires more capital expense, and significantly more modification of the stripping section, but achieves several stages of catalyst stripping, with at least the later stages at an elevated temperature. In this embodiment, it is preferred to use steam to transfer catalyst from the bubbling bed regenerator to the hot stripping zone. Use of steam on hot regenerated catalyst of course leads to some catalyst deactivation, but the residence time of the hot regenerated catalyst in the transfer line is preferably very short, and the steam used to transfer catalyst to the hot stripper also serves as stripping steam.

Figure 3:
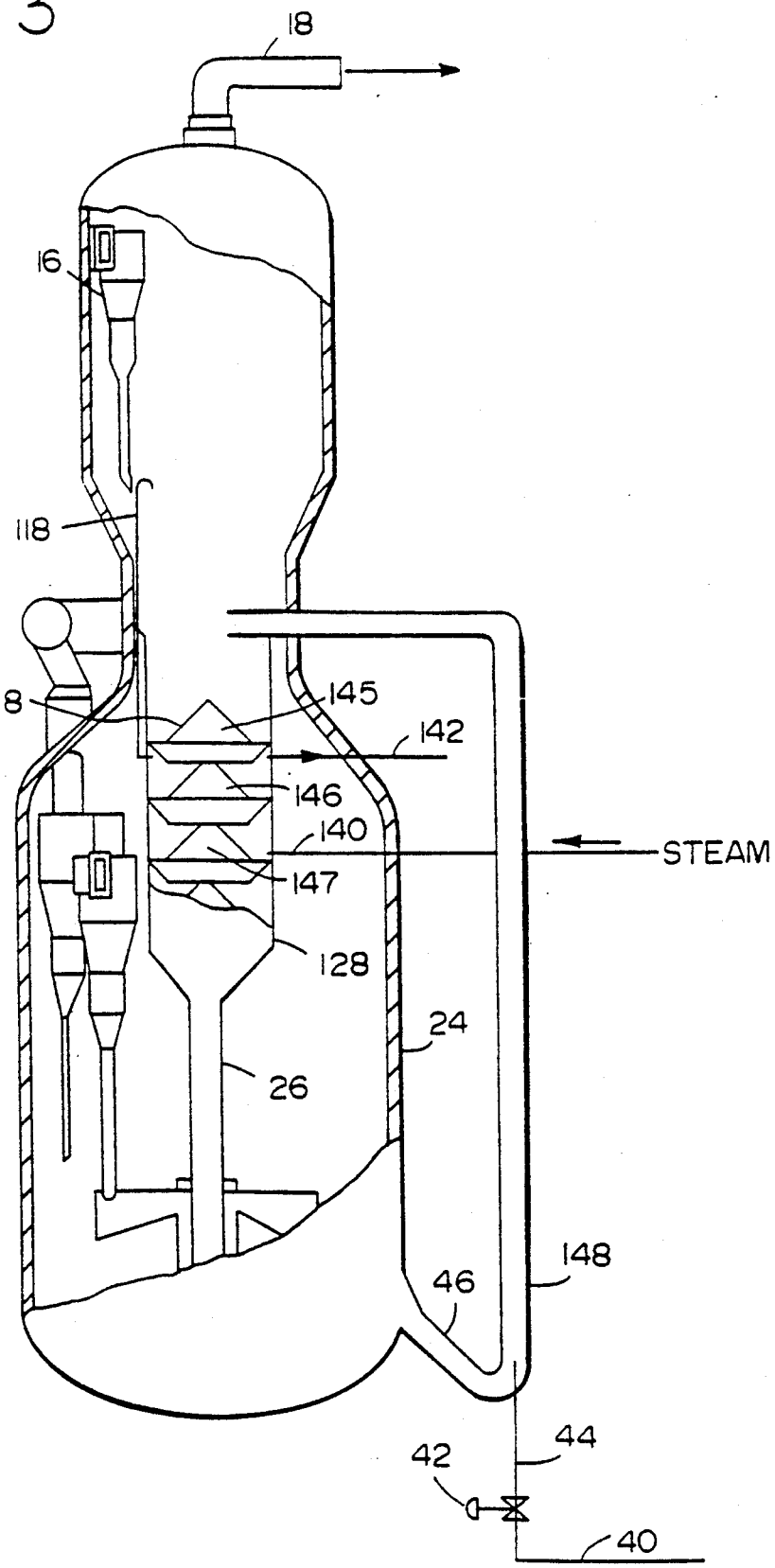
FIG. 3 (invention) is a schematic view of another preferred embodiment of the invention, showing hot catalyst recycle to a second stage of stripping, with steam transport of catalyst to the hot stripper.

As in the FIG. 2 embodiment, hot regenerated catalyst is withdrawn from the regenerator via line 46 to contact a lift gas, preferably steam in the FIG. 3 embodiment shown, and transported via transfer line 148 to the hot stripper 128. Spent catalyst from the reactor riser is discharged into a primary stripping zone 118, which function much as the prior art stripping zone shown in FIG. 1. This stripped catalyst flows down and mixes with hot recycled catalyst discharged from line 148. The stripped catalyst and hot recycled catalyst mix as they pass through the baffles 145, 146 and 147.

Although the steam used to transport hot regenerated catalyst to the hot stripping zone will be very effective stripping steam, it will not do any stripping in the hot stripping zone 140, but rather will be a very effective stripping material which will function as superheated stripping steam in the primary stripper 118. Because of the use of superheated steam in primary stripper 118, this stripper will operate at a slightly higher temperature, and be somewhat more efficient than the conventional stripping operation shown in FIG. 1. The stripping steam in the hot stripper is preferably added via one or more stripping steam injection means 140. Although only a single level of steam injection is shown in FIG. 3 it is possible, and frequently will be preferred, to operate with multiple levels of stripping steam injection.

Although it is possible to simply let the stripping steam and stripped hydrocarbons removed from the hot stripper to pass through the primary stripper, this is not preferred, because of the possible recapture of stripped hydrocarbons by catalyst. It is preferred to allow stripping steam and stripped products to bypass the primary stripper, either via an internal hot stripper vapor effluent line 118 or via an external hot stripper vapor effluent line 142.

Hot stripped catalyst is withdrawn from the hot stripper via a conventional standpipe 26, and regenerated as in the prior art unit shown in FIG. 1.

The FIG. 3 design, using steam as a lift gas on hot regenerated catalyst, is only possible because the hot stripper is so close to the regenerator, indeed is partially or totally within it, that the deactivating effect of steam can be tolerated.

It is also possible to use a light hydrocarbon lift gas, such as a light naphtha, in the FIG. 3 embodiment, but if this is done it may be beneficial to isolate the primary stripper from the hot stripper, so that hydrocarbons used to transport catalyst via line 148 into the hot stripper will not load up the catalyst discharged from the primary stripper with light hydrocarbons. Thus if light naphtha is used to transfer hot catalyst, it is beneficial to provide a cyclone separator at the end of the transfer line, as shown in the FIG. 2 embodiment, or to at least isolate the vapor from the hot stripper from the primary stripper.

Figure 4:
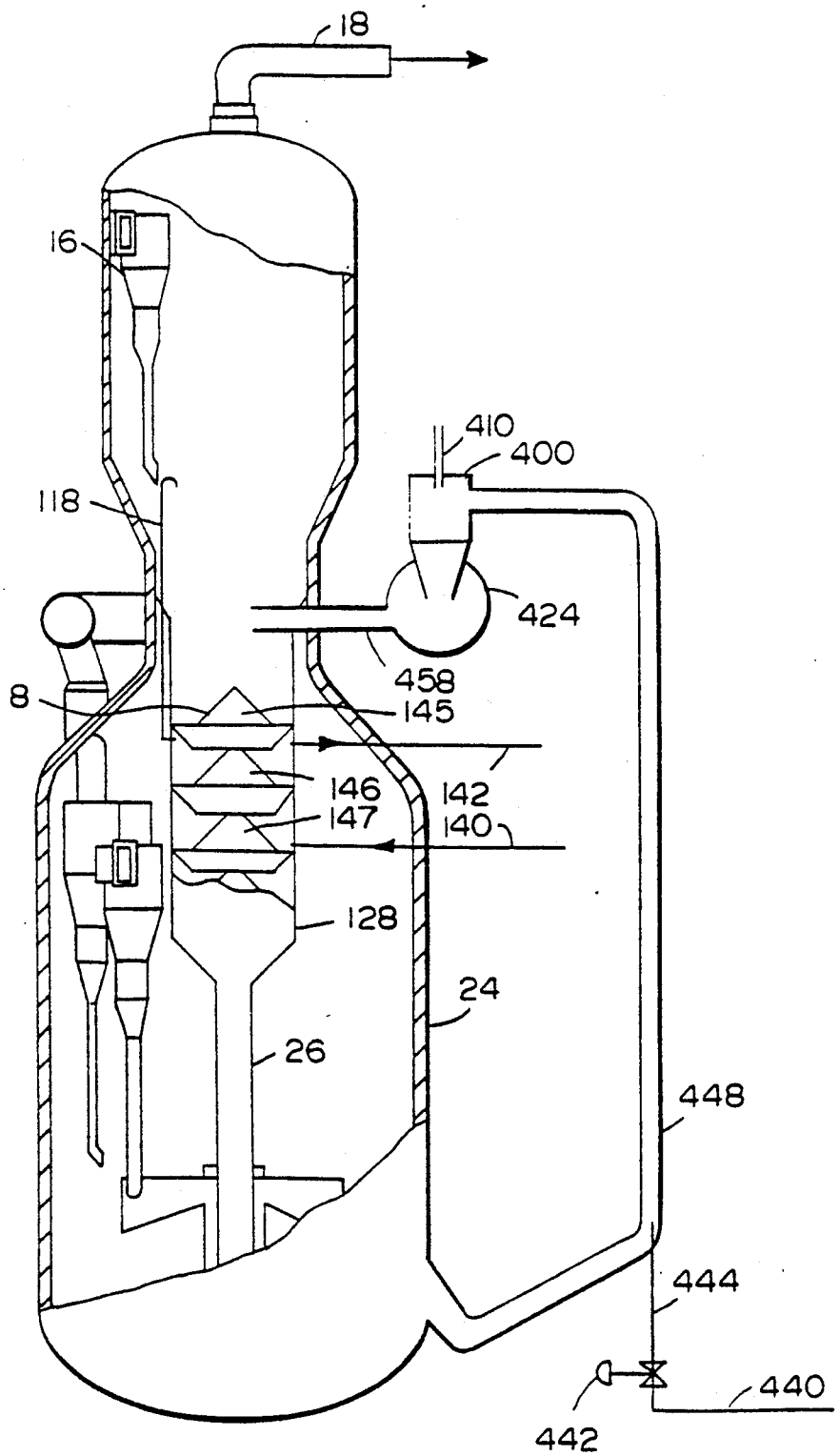
FIG. 4 (invention) is a schematic view of another preferred embodiment of the invention, showing hot catalyst recycle to a second stage of stripping, with air transport of catalyst to an elevated collector above the hot stripper.

The FIG. 4 embodiment also lends itself to a more conventional mode of transporting hot regenerated catalyst, i.e., use of air or an inert lift gas added via line 440, control valve 440 and air injector 444 to move the catalyst up transport line 448 from the regenerator 24 to a small vessel 424. The hot, regenerated catalyst from transport line 448 passes through a cyclone separator 400 which separates air from catalyst. Air is withdrawn via line 410, and beneficially is returned to the base of the regenerator by means not shown. In this way further catalyst/gas separation is not required, and good use can be made of the extremely hot air to burn coke in the regenerator. Multiple stages of cyclone separation can also be used to ensure a good separation of catalyst from air. Recovered catalyst is discharged from cyclone 400 into vessel 424 and can flow via line 458 to the hot stripper. Additional fluidizing gas, preferably an inert such as steam, may be used to aid in moving catalyst from vessel 424 into the hot stripper. The mode of operation shown in FIG. 4 does not steam the hot regenerated catalyst at all, as a dry lift gas is used. There is, however, some loss of energy in that the lift gas will be superheated by contact with hot regenerated catalyst, and this superheated lift gas will not be used to strip catalyst. There is a significant cost, too, for the closed vessel, cyclone separator and other equipment associated with an air lift system for moving hot regenerated catalyst from the bubbling bed regenerator to an elevation above the hot stripper. Some of the capital costs can be avoided, and some of the energy saved, by settling for a relatively low separation of catalyst from lift air, and discharging the recovered lift air into the dilute or dense phase region of the regenerator 24, depending on pressure balance.

DESCRIPTION OF PREFERRED EMBODIMENTS

FCC FEED

Any conventional FCC feed can be used. The process of the present invention is especially useful for processing difficult charge stocks, those with high levels of CCR material, exceeding 2, 3, 5 and even 10 wt % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids, and mixtures thereof. The present invention is very useful with heavy feeds having, and with those having a metals contamination problem. With these feeds, the possibility of reduced burning load in the regenerator, and even more importantly, the possibility of a dryer regenerator, because of reduced hydrogen content of coke, will be a significant benefit.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt.% of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles, or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Good additives for removal of SOx are available from several catalyst suppliers, such as Davison's "R" or Katalistiks International, Inc.'s "DeSox."

CO combustion additives are available from most FCC catalyst vendors.

The FCC catalyst composition, per se, forms no part of the present invention.

CRACKING REACTOR/REGENERATOR

The FCC reactor and regenerator shell 24, per se, are conventional, and are available from the M. W. Kellogg Company.

The modifications needed to add the regenerated catalyst lift line, and hot stripper are well within the skill of the art.

FCC REACTOR CONDITIONS

Conventional riser cracking conditions may be used. Typical riser cracking reaction conditions include catalyst/oil ratios of 0.5:1 to 15:1 and preferably 3:1 to 8:1, and a catalyst contact time of 0.1 to 50 seconds, and preferably 0.5 to 5 seconds, and most preferably about 0.75 to 2 seconds, and riser top temperatures of 900° to about 1050° F.

HOT STRIPPER CONDITIONS

Conventional hot stripping operating conditions may be used. Typical hot stripper operating conditions include temperatures which are at least 20° F. above the temperature in the conventional stripping zone, preferably at least 50° F. above the temperature in the conventional stripper, and most preferably temperatures in the hot stripper are at least 100° F. or more hotter.

A stripping gas or medium, preferably steam, is used for stripping. Preferably from 0.5 to 5.0 wt % steam, based on the weight of spent catalyst, is added to the hot stripping zone, in addition to the amount of stripping steam used in the conventional stripper. It is possible, and usually will optimize the overall operation of the unit, if the total amount of stripping steam used, in both the conventional stripper and the hot stripper, is roughly the same or increased only slightly. From 10 to 90%, and preferably 20 to 60%, of the total amount of stripping medium used is added to the hot stripper. This will reduce the amount of steam added to the primary stripper, and reduce the efficiency of the primary stripper, and shift the stripping duty to the hot stripper. In this way, the overall stripping efficiency can be greatly increased, without loading up the process lines with steam, and greatly increasing the production of sour water in downstream units.

LIGHT HYDROCARBON

In a preferred embodiment, the process of the present invention uses a light hydrocarbon to transport hot regenerated catalyst from the regenerator to the hot stripping zone. This has the dual advantage of transporting catalyst without steaming it, and achieving some beneficial conversion and upgrading reactions while transporting catalyst to the hot stripper.

Any light hydrocarbon can be used, preferably a relatively low coke forming material such as dry gas, wet gas, LPG, light naphtha, heavy naphtha, and similar materials which are readily vaporizable by hot hydrocarbons and which have, or can be cracked to form, low molecular weight materials to generate large volumes of gas for efficient transport of catalyst.

CO COMBUSTION PROMOTER

Use of a CO combustion promoter in the regenerator or combustion zone is not essential for the practice of the present invention, however, it is preferred. These materials are well-known.

U.S. Pat. Nos. 4,072,600 and 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit.

DISCUSSION OF HOT STRIPPING BENEFITS

The hot stripper temperature controls the amount of carbon removed from the catalyst in the hot stripper. Accordingly, the hot stripper controls the amount of carbon (and hydrogen and sulfur) remaining on the catalyst to the regenerator. This residual carbon level controls the temperature rise between the reactor stripper and the regenerator. The hot stripper also controls the hydrogen content of the spent catalyst sent to the regenerator as a function of residual carbon. Thus, the hot stripper controls the temperature and amount of hydrothermal deactivation of catalyst in the regenerator.

Employing a hot stripper, to remove carbon on the catalyst, rather than a regeneration stage reduces air pollution, and allows all of the carbon made in the reaction to be burned to CO2, if desired.

The present invention strips catalyst at a temperature higher than the riser exit temperature to separate hydrogen, as molecular hydrogen or hydrocarbons from the coke which adheres to catalyst. This minimizes catalyst steaming, or hydrothermal degradation, which typically occurs when hydrogen reacts with oxygen in the FCC regenerator to form water. The high temperature stripper (hot stripper) also removes much of the sulfur from coked catalyst as hydrogen sulfide and mercaptans, which are easy to scrub. In contrast, burning from coked catalyst in a regenerator produces SOx in the regenerator flue gas. The high temperature stripping recovers additional valuable hydrocarbon products to prevent burning these hydrocarbons in the regenerator.

The process and apparatus of the present invention provides great flexibility, and some unusual stripping options. These can be summarized as follows:

1. Chemical reactions during catalyst transport to the stripper.
2. "Warm" primary stripping, followed by "hot" secondary stripping.
3. Air lift hot stripping.

The first approach, as exemplified by FIG. 2, allows significant catalytic upgrading reactions to occur while moving catalyst from the regenerator to the hot stripper. Naphtha transport of hot regenerated catalyst moves catalyst to the stripper without deactivating it, and achieves some beneficial naphtha blasting in the process.

The second approach, which can be achieved using the FIG. 2 or FIG. 3 apparatus with only minor modifications, allows use of steam to move catalyst from the regenerator to the stripper, preferably to the second stage stripper. By using properly sized transfer lines, it is possible to have a very short residence time in the transfer line from the regenerator to the stripper second stage, preferably under 15 seconds, and most preferably under 10 seconds. This short residence time will minimize catalyst deactivation by steam in the lift line. The steam will be superheated efficiently by the hot regenerated catalyst, and this superheated steam will be unusually effective at stripping heavy, but labile, hydrocarbons in the primary stripper. The primary stripper will be "warm" because of the use of superheated steam, at a temperature approaching that of the regenerator, for at least some of the stripping steam. The secondary stripper will be "hot" because of the presence of recycled, regenerated catalyst.

The overall steaming of catalyst in the regenerator will be reduced, because the more efficient "warm" and "hot" stripping will reduce the hydrogen content of the coke entering the regenerator, and reducing the steam partial pressure in the regenerator.

Use of an air lift (FIG. 4) to move catalyst from the regenerator up to the stripper avoids steam induced deactivation of catalyst, but requires some additional capital expense for a catalyst/air separator, and incurs some penalty in creating a superheated air stream. The energy penalty, and some of the capital expense of cyclone separators, can be avoided by discharging the lift air back into the regenerator vessel.

The multi-stage hot stripper of the FIG. 3 and 4 embodiments gradually increases the temperature of the spent catalyst. This will reduce steaming of the catalyst in the stripper to some extent and also may reduce the diolefin content of the stripped product. If catalyst contacts hydrocarbons for too long a time at temperatures above 538° C. (1000° F.), then diolefins may be produced which are undesirable for downstream processing, such as alkylation.

We claim:

1. A fluidized catalytic cracking process wherein a heavy hydrocarbon feed comprising hydrocarbons having a boiling point above about 650° F. is catalytically cracked to lighter products comprising the steps of:

catalytically cracking said feed in a catalytic cracking zone operating at catalytic cracking conditions by mixing, in the base of a riser reactor, a heavy crackable feed with a source of hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst;

separating cracked products from spent catalyst in said catalyst disengaging zone to produce a cracked product vapor phase which is recovered as a product and a spent catalyst phase which is discharged from said disengaging zone into a catalyst stripper contiguous with and beneath said disengaging zone;

steam stripping said spent catalyst with stripping steam in said stripping zone to produce a stripper vapor comprising cracked products and stripping steam which is removed from said stripping zone as a product and a stripped catalyst phase comprising stripped catalyst having a temperature is discharged into a vertical standpipe beneath said stripping zone;

discharging stripped catalyst from said standpipe into a catalyst regeneration zone contiguous with and beneath said stripping zone;

regenerating said stripped catalyst in a regeneration zone comprises a single dense phase bubbling fluidized bed of catalyst to which an oxygen containing regeneration gas is added and from which hot regenerated catalyst, having a regenerated catalyst temperature above said stripped catalyst temperature, is withdrawn and recycled to said riser reactor, characterized by:

heating in a hot stripping zone contiguous with and beneath said steam stripper said stripped catalyst from said steam catalyst stripper by direct contact heat exchange with hot regenerated catalyst from said bubbling dense bed, discharging the resulting heated catalyst into a hot stripping zone and stripping said heated catalyst therein by adding a stripping gas to said hot stripper, and stripping additional cracked products from said stripped catalyst to produce hot stripped catalyst which is discharged down into said catalyst regeneration zone and hot stripper vapor which is removed as a product and further characterized in that the hot regenerated catalyst is transported from said bubbling dense bed via a lift pipe transport means and lifted in said lift pipe with a lift gas to an elevation above said hot stripping zone and said regenerated catalyst and said lift gas are discharged within the stripping zone.

2. The process of claim 1, wherein a reactive light hydrocarbon is the lift gas.

3. The process of claim 1 wherein steam is the lift gas, and said regenerated catalyst is discharged between the catalyst stripper contiguous with and beneath said disengaging zone and said hot stripping zone, and wherein steam lift gas is superheated by contact with hot regenerated catalyst, and said superheated steam rises up into the catalyst stripper contiguous with and beneath said disengaging zone.

4. The process of claim 1 wherein hot regenerated catalyst is transported from said bubbling dense bed via a lift pipe transport means and lifted in said lift pipe with a lift gas to an elevation above said hot stripping zone, and said lift pipe discharges into a catalyst/lift gas separation means, and said lift gas is separated from said regenerated catalyst, and regenerated catalyst essentially free of lift gas is added to said hot stripping means.

5. The process of claim 4 wherein a naphtha boiling range hydrocarbon is used as the lift gas, and the catalyst/lift gas separation means is located within said disengaging zone used to separate cracked products from spent catalyst, and the products of naphtha cracking are mixed with the products of riser cracking.

6. The process of claim 4 wherein air or an inert lift gas is used, and said lift pipe transport means terminates in an external catalyst/lift gas separation means.

7. The process of claim 1 wherein said hot stripping zone comprises multiple means for stripping gas addition at multiple elevations and multiple means for removal of stripping gas and stripped hydrocarbons at multiple elevations.

8. The process of claim 7 wherein said multiple means for removal of stripping gas and stripped hydrocarbons communicate with a vapor space containing said disengaging zone used to separate cracked products from catalyst exiting the riser reactor.

9. The process of claim 1 wherein the amount of hot regenerated catalyst added to the hot stripping means is 5 to 150 wt % of the spent catalyst.

10. The process of claim 1 wherein the amount of hot regenerated catalyst added to the hot stripping means is 10 to 60 wt % of the spent catalyst.

11. The process of claim 1 wherein the hot regenerated catalyst transported via the lift pipe is added to the catalyst stripper contiguous with and beneath said disengaging zone.

* * * * *